United States Patent [19]

Babiol

[11] 4,010,875

[45] Mar. 8, 1977

[54] POURER-STOPPER

[75] Inventor: Pierre Babiol, Villefranche-sur-Saone, France

[73] Assignee: Le Bouchage Mecanique, Paris, France

[22] Filed: Jan. 13, 1976

[21] Appl. No.: 648,707

[30] Foreign Application Priority Data

Jan. 16, 1975 France ..... 75.02014

[52] U.S. Cl. ..... 222/517; 215/235

[51] Int. Cl.[2] ..... B67D 3/00

[58] Field of Search ..... 215/235, 237, 306, 307; 220/335; 222/515, 517, 543, 556, 562, 498

[56] References Cited

UNITED STATES PATENTS

| | | | |
|---|---|---|---|
| 1,794,987 | 3/1931 | Sebolt | 222/498 X |
| 3,059,816 | 10/1962 | Goldstein | 222/543 X |
| 3,240,405 | 3/1966 | Abbott | 222/543 |
| 3,441,161 | 4/1969 | Van Baarn | 215/235 |
| 3,741,447 | 6/1973 | Miles | 222/517 |
| 3,752,371 | 8/1973 | Susuki | 222/517 X |
| 3,853,250 | 12/1974 | Alpern | 222/517 |

*Primary Examiner*—Donald F. Norton
*Attorney, Agent, or Firm*—Dowell & Dowell

[57] ABSTRACT

A pourer-stopper consists of a one-piece moulding having a stoppering device and an integrally hinged cap provided with a spring blade which cooperates with a tongue on the stoppering device to cause the cap to spring from a partially open position to a fully open position; the blade obstructs free return of the cap from the fully open position regardless of the attitude of the device in pouring.

6 Claims, 4 Drawing Figures

F
F1

POURER-STOPPER

The present invention relates to pourer stoppers more especially intended for use with a container holding a liquid poured by means of a spout having a very small aperture so that the said liquid flows in the form of a jet. Pourer stoppers of this kind are used particularly on containers for liquids such as cleaning materials and syrups.

Stoppers of the type in question generally comprise a stoppering device which is fixed on to the neck of the container and a cap suitable for enabling restoppering of the pourer spout associated with the aforesaid device, this cap being connected to the stoppering device by means of a flexible tab. The disadvantage of such units lies in the fact that during pouring of the liquid the cap lies in the majority of cases in the path of the latter, and the present invention aims at removing or at least reducing this disadvantage.

Accordingly, the invention provides a pourer-stopper comprising a stoppering device provided with a discharge spout and a cap for shutting off the latter, hinged to the said device by a connecting tab, and resilient means which assist movement of the cap from a partially open position to a fully open position with respect to the device and prevent free return of the cap to a partially open position.

One form of stopper in accordance with the invention is described below, by way of example, with reference to the accompanying drawing, in which.

Figures 1, 2, 3, 4:
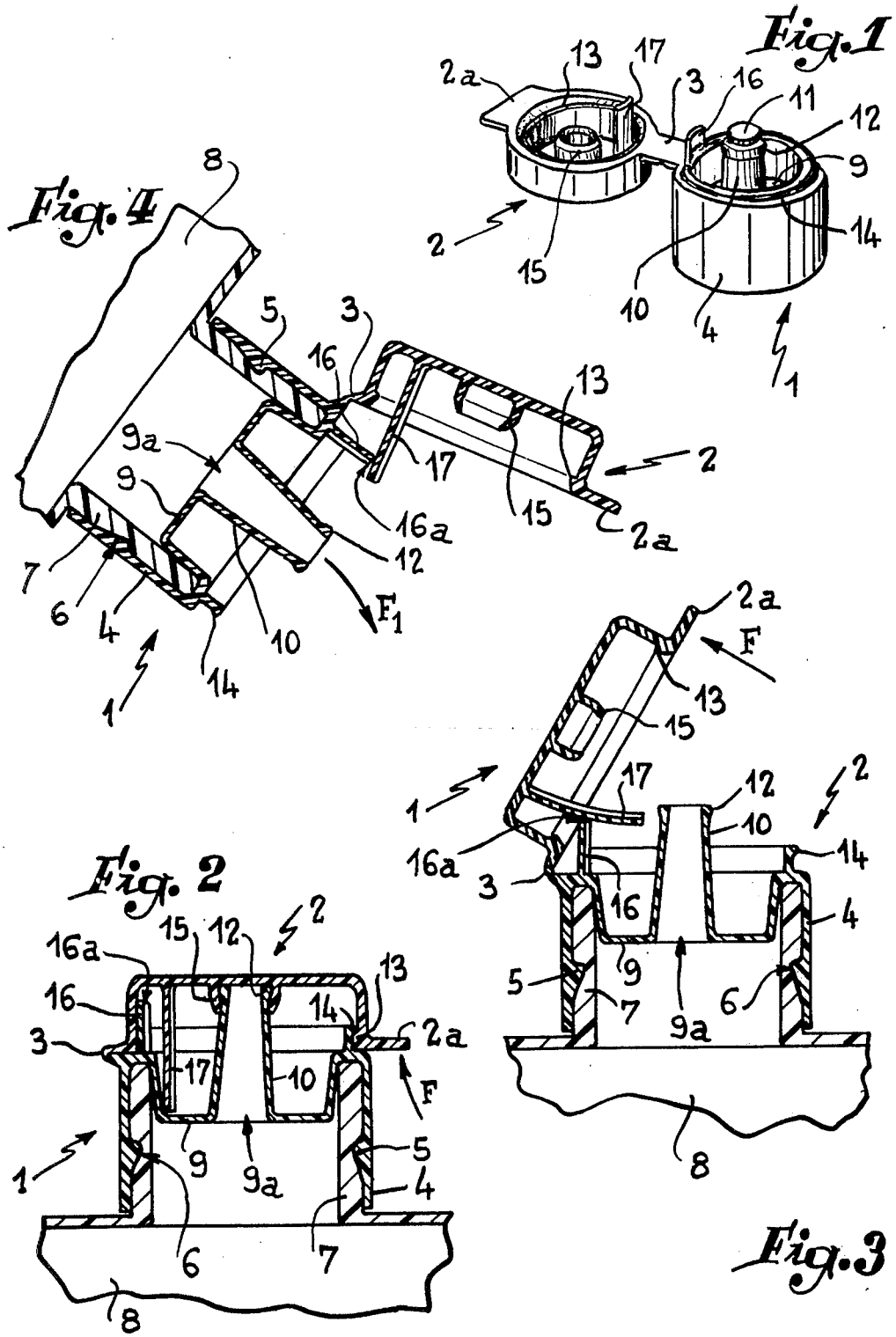
FIG. 1 is a perspective of a pourer stopper in accordance with the invention, shown in the completely open state just as it leaves the shaping mould.
FIG. 2 is an axial section of the pourer stopper on a larger scale, in the closed position and mounted on to the neck of a container.
FIG. 3 illustrates the pourer stopper during the course of opening.
FIG. 4 is a view like that of FIG. 3 but showing the pourer stopper during use.

The pourer stopper illustrated comprises essentially a stoppering device 1 and a closure cap 2 joined by an integral connecting tab 3 serving as a hinge.

The device 1 comprises a skirt 4, the inner face of which is furnished with a bead 5 suitable for engaging in a groove 6 formed in the outer wall of the neck 7 of a container 8 (FIG. 2). The upper portion of the skirt 4 rests against the end of the neck 7 where it is connected to a circular cup 9 fitting inside this neck. The central portion of the cup 9 has an opening **9*a* which surrounds a frusto-conical spout 10. The outlet from this spout is closed by a lid 11 suitable for being cut away before use. On the periphery of the spout 10 and at the level of the lid 11 there is provided a bead 12**, the purpose of which is explained more fully below.

The connecting tab 3 starts from the top of the skirt 4 and ends at the bottom of the periphery of the shut-off cap 2. The latter is provided with an inner bead 13 suitable for engaging under a rim 14 which extends above the joint between the skirt 4 and the cup 9 of the stoppering device. Once the lid 11 has been cut away, when the cap 2 is snapped in with respect to the device 1 a collar 15 carried by the end of the cap comes into place round the end of the spout 10 to shut it off. This collar 15 is of reduced diameter at its free end, so as to constitute a resilient hold-down with respect to the bead 12.

The stoppering device 1, adjacent and inwardly of the connecting tab 3, has a vertical tongue 16, the top edge of which is located below the plane of the mouth of the spout 10, that is to say, it lies at some distance from the end of the cap when the latter is closed. On this end and opposite the tab 3 and the tongue 16, there is provided a blade 17 which extends perpendicular to the plane of the said end and the length of which is such that when the pourer stopper is closed, the free edge of the said blade lies at a very short distance from the bottom of the cup 9 (FIG. 2). Thus, the length of this blade is much greater than that of the tongue 16. The tongue and the blade 17 are advantageously made concave in the direction of the centre of the element which carries them (i.e. in radial cross-section), in order to increase their resistance to bending and consequently enhance the desired spring effect.

The pourer stopper is preferably produced from a plastics material such as polypropylene, so that on the one hand the connecting tab 3 is practically unbreakable and constitutes a hinge, while on the other hand, the blades 16 and 17 are suitably resilient.

In order to open the pourer stopper, the user presses in the direction of the arrow F upon the peak **2*a* of the cap 2 so as to make the latter pivot with respect to the stoppering device 1. At a certain point in the rotation of the cap 2, the blade 17 comes to bear against the free top edge 16*a* of the tongue 16, the former flexing as shown in FIG. 3. When the rotation of the cap is slightly greater than 45° the blade 17 straightens resiliently and levers the cap to the fully open position shown in FIG. 4. A position of equilibrium is then achieved (FIG. 4) so that in all attitudes of the container 8, and most importantly, when its neck is pointing downwards in order to discharge its contents in the direction of the arrow F1, the cap 2** cannot obstruct the path of the discharging material.

Thus, in the described pourer stopper, the discharge spout stopper of which has two stable positions: one corresponding with complete opening, and the other with closure of the pourer spout. The blade 17 and tongue 16 assist movement of the cap from the partially open position of FIG. 3 to the fully open position of FIG. 4, and prevent free return of the cap to the partially open position in which it could obstruct the discharge of liquid from the container.

I claim:

1. A pourer-stopper comprising a stoppering device adapted for mounting on a container neck, and having a first portion having a discharge spout, a second portion including a cap for shutting off the spout and hinged to the said first portion by a connecting tab, and resilient means acting between said portions and operable to assist movement of said cap from a partially open position to a fully open position and to prevent free return of said cap from said fully open position, said resilient means including a flexible blade integral with one of said stoppering device portions and extending generally axially thereof and including a cooperating tongue integral with the other of said portions and extending generally axially thereof, said blade being adapted to flex in response to engagement with said tongue during opening movement of said cap whereby initially to resist opening and then to straighten resiliently to lever said cap to said fully open position.

2. A pourer-stopper as claimed in claim 1, wherein said resilient means is disposed to cooperate during opening and closing movement of said cap to pass through a point of unstable equilibrium at said partially open position and thereafter to retain said cap to either side of said partially open position.

3. A pourer-stopper as claimed in claim 1, wherein said blade is formed integrally with said cap, is disposed radially inwardly of said tongue and is of greater axial length than said tongue.

4. A pourer-stopper as claimed in claim 1, wherein said blade and said tongue are concave in radial cross-section.

5. A pourer-stopper as claimed in claim 1, wherein the angular movement of said cap between its fully closed and fully open position is greater than 90°.

6. A pourer-stopper as claimed in claim 1, when made entirely of polypropylene.

* * * * *